US009389568B1

(12) United States Patent
Ishizaki

(10) Patent No.: US 9,389,568 B1
(45) Date of Patent: Jul. 12, 2016

(54) IMAGE FORMING APPARATUS

(71) Applicant: KYOCERA Document Solutions Inc., Osaka (JP)

(72) Inventor: Atsushi Ishizaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/757,536

(22) Filed: Dec. 23, 2015

(30) Foreign Application Priority Data

Dec. 24, 2014 (JP) ..... 2014-260176

(51) Int. Cl.
*G03G 15/00* (2006.01)

(52) U.S. Cl.
CPC ..... *G03G 15/556* (2013.01); *G03G 2215/1647* (2013.01); *G03G 2215/1661* (2013.01)

(58) Field of Classification Search
CPC ..... G03G 2215/1647; G03G 2215/1661
USPC ..... 399/49
See application file for complete search history.

(56) References Cited

U.S. PATENT DOCUMENTS 5,655,205 A * 8/1997 Ziegelmuller ..... G03G 21/0005 399/162
5,797,078 A * 8/1998 Sass ..... G03G 21/0035 399/353
8,145,110 B2 * 3/2012 Condello ..... G03G 15/2025 399/323
2012/0199443 A1 * 8/2012 Kaneyama ..... G03G 15/161 198/496

FOREIGN PATENT DOCUMENTS

JP 2009-15029 1/2009
JP 2009015029 A * 1/2009

* cited by examiner

*Primary Examiner* — David Gray
*Assistant Examiner* — Tyler Hardman
(74) *Attorney, Agent, or Firm* — Wenderoth, Lind & Ponack, L.L.P.

(57) ABSTRACT

A positioning member has a positioning surface that abuts an inner peripheral surface of an intermediate transfer belt to perform the positioning of the intermediate transfer belt with respect to a density detection sensor and a cleaning surface coated with a cleaning member having hardness lower than that of the positioning surface and abutting the inner peripheral surface of the intermediate transfer belt via the cleaning member. When a correction process is performed by a density correction section, the positioning surface of the positioning member 36 abuts the inner peripheral surface of the intermediate transfer belt, and when the correction process is not performed by the density correction section, the cleaning surface of the positioning member abuts the intermediate transfer belt.

7 Claims, 6 Drawing Sheets

IMAGE FORMING APPARATUS

CROSS-REFERENCE TO RELATED APPLICATION

This application is based upon and claims the benefit of priority from Japanese Patent Application No. 2014-260176 filed on Dec. 24, 2014, the entire contents of which are incorporated herein by reference.

BACKGROUND

The technology of the present disclosure relates to an image forming apparatus of an intermediate transfer system.

Conventionally, there has been known an image forming apparatus of an intermediate transfer system in which a toner image formed on a peripheral surface of a photosensitive drum is transferred to an intermediate transfer belt by a primary transfer roller and then is transferred to a recording paper by a second transfer roller. The intermediate transfer belt is rotationally driven by a driving roller abutting an inner peripheral surface thereof. The aforementioned toner image is formed on an outer peripheral surface of the intermediate transfer belt. In this type of image forming apparatus, a density correction unit for correcting image density may be provided. The density correction unit forms a test image for density adjustment on the outer peripheral surface of the intermediate transfer belt and adjusts a developing bias based on the density of the test image detected by a density detection sensor, thereby correcting image density. The density detection sensor is arranged at a radial outside of the intermediate transfer belt. A positioning member is provided at a position facing the density detection sensor while the intermediate transfer belt is held between the density detection sensor and the positioning member. The positioning member abuts the inner peripheral surface of the intermediate transfer belt, thereby performing the positioning of the intermediate transfer belt with respect to the density detection sensor. In this way, the detection accuracy of image density by the density detection sensor is improved.

SUMMARY

An image forming apparatus according to one aspect of the present disclosure includes a photosensitive drum, an endless intermediate transfer belt, a driving roller, a secondary transfer roller, a test image forming section, a density detection sensor, a positioning member, and a density correction section. On a peripheral surface of the photosensitive drum, a toner image is formed. The toner image of the peripheral surface of the photosensitive drum is primarily transferred to the intermediate transfer belt. The driving roller abuts an inner peripheral surface of the intermediate transfer belt and rotationally drives the intermediate transfer belt. The secondary transfer roller secondarily transfers the toner image transferred to the aforementioned intermediate transfer belt to a recording paper. The test image forming section forms a test image on an outer peripheral surface of the intermediate transfer belt. The density detection sensor is arranged at a radial outside of the intermediate transfer belt and detects the density of the test image formed by the test image forming section. The positioning member is arranged facing the density detection sensor while the intermediate transfer belt is held between the density detection sensor and the positioning member and abuts the inner peripheral surface of the intermediate transfer belt. The density correction section performs an image density correction process based on the density of the test image detected by the aforementioned density detection sensor.

Furthermore, the aforementioned positioning member has a positioning surface and a cleaning surface. The positioning surface abuts the inner peripheral surface of the aforementioned intermediate transfer belt to perform the positioning of the intermediate transfer belt with respect to the aforementioned density detection sensor. The cleaning surface is coated with a cleaning member having hardness lower than that of the positioning surface and abuts the inner peripheral surface of the aforementioned intermediate transfer belt via the cleaning member. Furthermore, the aforementioned image forming apparatus further includes a state switching mechanism and a control unit. The state switching mechanism is configured to be able to switch a positioning state in which the positioning surface of the aforementioned positioning member abuts the inner peripheral surface of the aforementioned intermediate transfer belt and a cleaning state in which the cleaning surface of the aforementioned positioning member abuts the inner peripheral surface of the aforementioned intermediate transfer belt and cleans the inner peripheral surface. The control unit allows the aforementioned state switching mechanism to be in the aforementioned positioning state when the aforementioned correction process is performed by the aforementioned density correction section while allowing the aforementioned state switching mechanism to be in the aforementioned cleaning state when the aforementioned correction process is not performed by the aforementioned density correction section.

DETAILED DESCRIPTION

Hereinafter, an example of an embodiment of the technology of the present disclosure will be described in detail on the basis of the drawings. It is noted that the technology of the present disclosure is not limited to the following embodiments.

Figure 1:
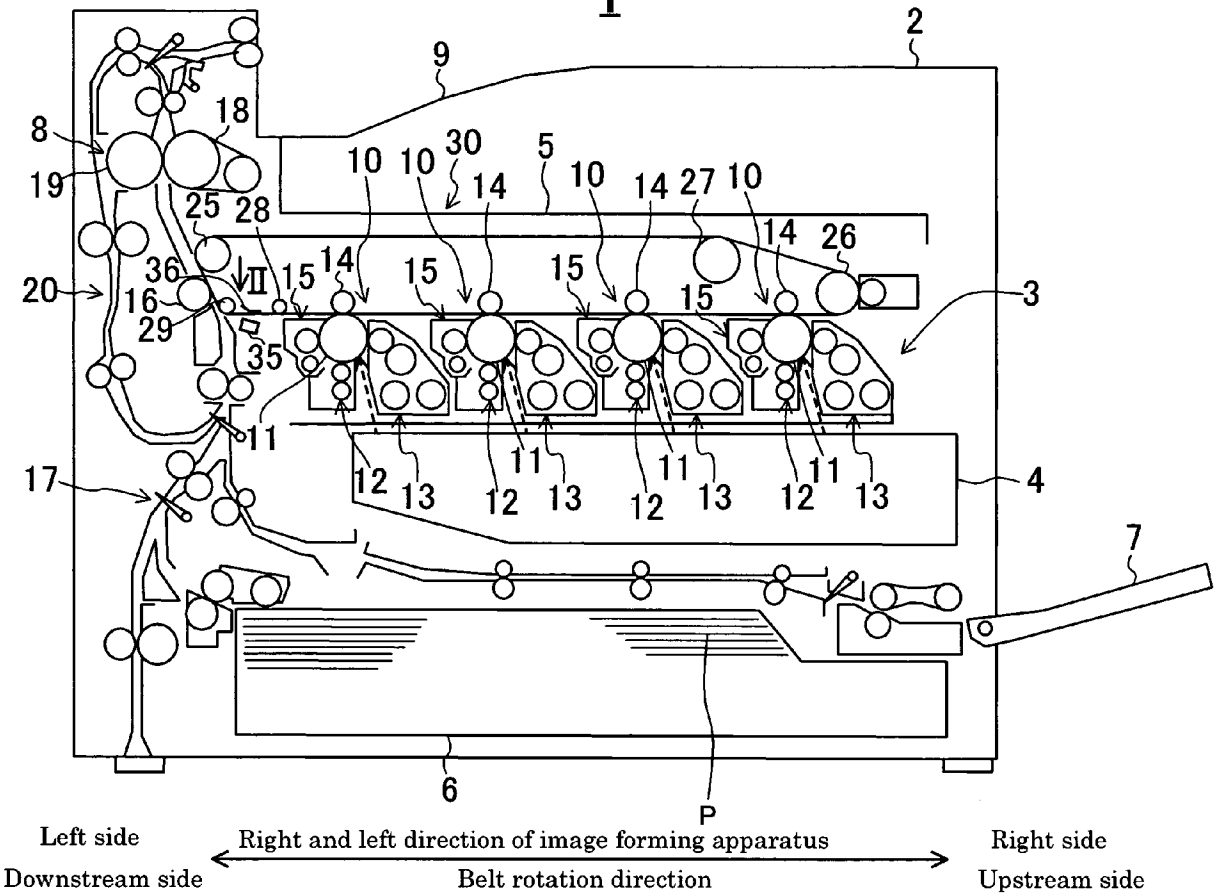
FIG. 1 is a schematic overall view illustrating an image forming apparatus in an embodiment.

FIG. 1 is a schematic configuration diagram of an image forming apparatus 1 according to one example of an embodiment of the technology of the present disclosure. In the following description, a front side and a rear side indicate a front side and a back side (a front side and a back side of FIG. 1) of the image forming apparatus 1, and a left side and a right side indicate a left side and a right side when the image forming apparatus 1 is viewed from the front side.

The aforementioned image forming apparatus 1 is a tandem type color printer and includes an image forming unit 3 in a box-like casing 2. The image forming unit 3 is an element that transfers an image to a recording paper P and forms the image on the recording paper P on the basis of image data transmitted from an external device such as a computer subjected to network connection and the like. Below the image forming unit 3, an exposure device 4 is arranged to irradiate laser light, and above the image forming unit 3, an intermediate transfer unit 30 having an intermediate transfer belt 5 is arranged. Below the exposure device 4, a paper storage unit 6 is arranged to store the recording paper P, and at the right side of the paper storage unit 6, a manual paper feeding unit 7 is arranged. At the left side and the upper side of the intermediate transfer unit 30, a fixing unit 8 is arranged to perform a fixing process on the image transferred to and formed on the recording paper P. A reference numeral 9 indicates a paper discharge unit which is arranged at an upper portion of the casing 2 and discharges the recording paper P subjected to the fixing process in the fixing unit 8.

The image forming unit 3 includes four image forming units 10 arranged in a row along the intermediate transfer belt 5. These image forming units 10 have photosensitive drums 11, respectively. Directly under each photosensitive drum 11, a charging device 12 is arranged, and at the right side of each photosensitive drum 11, a developing device 13 is arranged. Directly above each photosensitive drum 11, a primary transfer roller 14 is arranged, and at the left side of each photosensitive drum 11, a cleaning unit 15 is arranged to clean the peripheral surface of the photosensitive drum 11.

The peripheral surface of each photosensitive drum 11 is uniformly electrified by the charging device 12, and laser light corresponding to each color based on the image data inputted from the aforementioned computer and the like is irradiated from the exposure device 4 to the electrified peripheral surface of the photosensitive drum 11, so that an electrostatic latent image is formed on the peripheral surface of each photosensitive drum 11. A developer is supplied to the electrostatic latent images from the developing device 13, so that a toner image of yellow, magenta, cyan, or black is formed on the peripheral surface of each photosensitive drum 11. These toner images are respectively superposed on and transferred to the intermediate transfer belt 5 by a transfer bias applied to the primary transfer roller 14.

A reference numeral 16 indicates a secondary transfer roller arranged below the fixing unit 8, the recording paper P conveyed from the paper storage unit 6 or the manual paper feeding unit 7 through a paper conveyance path 17 is interposed between the secondary transfer roller 16 and the intermediate transfer belt 5, and the toner images on the intermediate transfer belt 5 are transferred to the recording paper P by a transfer bias applied to the secondary transfer roller 16.

The fixing unit 8 includes a heating roller 18 and a pressing roller 19, and heats and presses the recording paper P while interposing the recording paper P between these heating roller 18 and pressing roller 19, thereby fixing the toner images, which have been transferred to the recording paper P, to the recording paper P. The recording paper P subjected to the fixing process is discharged to the paper discharge unit 9. A reference numeral 20 indicates an inversion conveyance path for inverting the recording paper P discharged from the fixing unit 8 at the time of duplex printing.

The intermediate transfer belt 5 is formed in an endless state and is wound around a driving roller 25 and first to fourth tension rollers 26 to 29. The driving roller 25 is connected to a motor (not illustrated) and is arranged at the right side and the upper side of the secondary transfer roller 16. The first tension roller 26 is arranged directly above the developing device 13 positioned at the rightmost side. The second tension roller 27 is arranged at the left side and the upper side of the first tension roller 26. The third tension roller (an upstream side tension roller) 28 and the fourth tension roller (a downstream side tension roller) 29 are arranged at a left side from the primary transfer roller 14 positioned at the leftmost side (a downstream side of a belt rotation direction). Both end portions of each of these rollers 25 to 29 are rotatably supported to a side wall portion (not illustrated) of the intermediate transfer unit 30.

Figure 2:
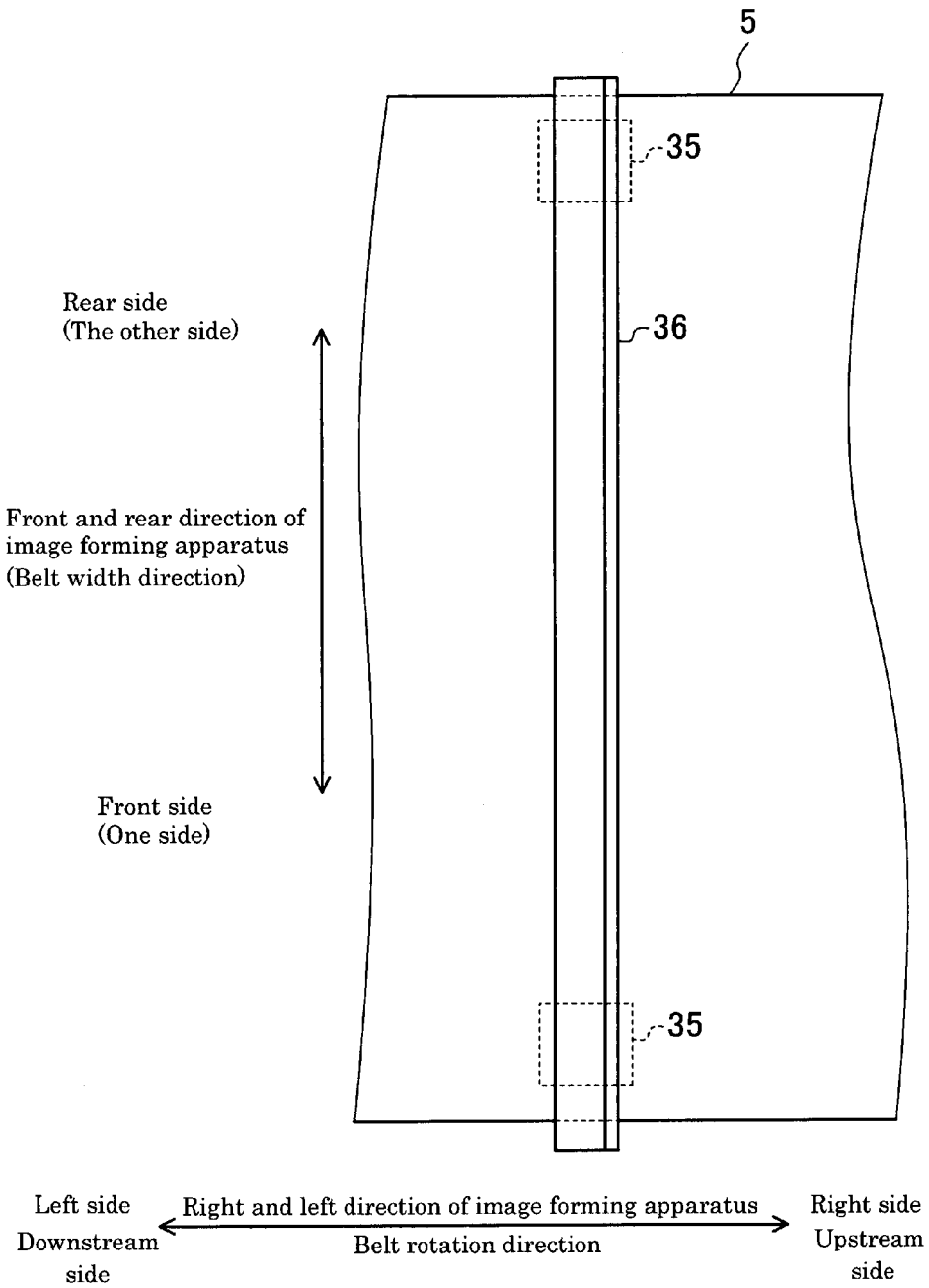
FIG. 2 is a view viewed in the arrow direction of II of FIG. 1.

Between the aforementioned third tension roller 28 and fourth tension roller 29, a positioning member 36 is arranged to perform the positioning of a position (a distance) of the intermediate transfer belt 5 with respect to density detection sensors 35. As illustrated in FIG. 2, a total of 2 aforementioned density detection sensors 35 are provided and the density detection sensors 35 are arranged at a radial outside with respect to the intermediate transfer belt 5. Both density detection sensors 35 are arranged facing both end portions of the outer peripheral surface of the intermediate transfer belt 5 in a width direction. Both density detection sensors 35 are electrically connected to a controller 100 which will be described later.

The aforementioned positioning member 36 is arranged facing the two density detection sensors 35 while the intermediate transfer belt 5 is held between the two density detection sensors 35 and the positioning member 36. The positioning member 36 is configured with a sheet metal member which is long in the belt width direction. Preferably, the positioning member 36, for example, includes a stainless steel, an iron and the like. Both end portions of the positioning member 36 in a longitudinal direction are fixedly supported to the side wall portion (not illustrated) of the intermediate transfer unit 30.

Figure 3:
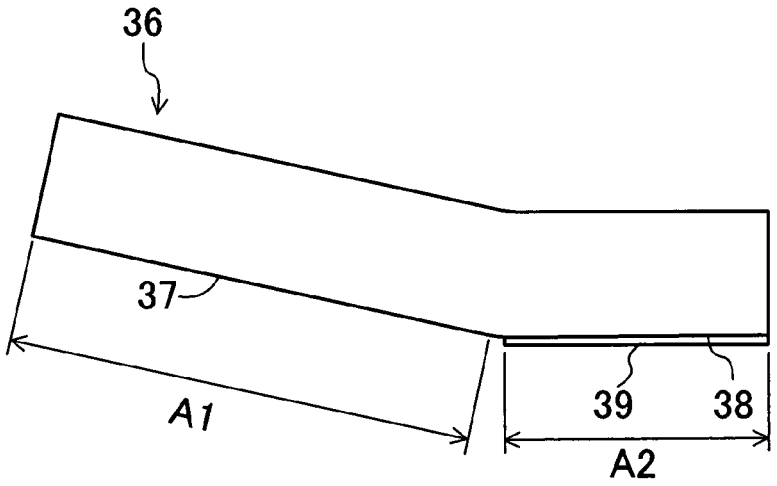
FIG. 3 is a side view when a positioning member is viewed from one side of a longitudinal direction.

As illustrated in FIG. 3, the positioning member 36 has a positioning surface 37 and a cleaning surface 38. The positioning surface 37 abuts the inner peripheral surface of the intermediate transfer belt 5, thereby performing the positioning of the intermediate transfer belt 5 with respect to the density detection sensors 35. The cleaning surface 38 abuts the inner peripheral surface of the intermediate transfer belt 5 via a cleaning member 39, thereby cleaning the inner peripheral surface. The positioning surface 37 and the cleaning surface 38 respectively include rectangular flat surfaces which are long in the belt width direction. The lengths of the positioning surface 37 and the cleaning surface 38 in the belt width direction are equal to each other. The length A1 of the positioning surface 37 in the belt rotation direction is sufficiently larger than the length A2 of the cleaning surface 38 in the belt rotation direction. That is, the area of the positioning surface 37 is sufficiently larger than that of the cleaning surface 38. The positioning surface is connected to a downstream side end of the cleaning surface 38 in the belt rotation direction. The positioning surface 37 is inclined inward with respect to the cleaning surface 38 in the radial direction of the belt toward a downstream side of the belt rotation direction. The whole positioning surface 37 has been subjected to insulating coating. At least a part of the cleaning surface 38 is covered by the cleaning member 39. The cleaning member 39 is configured with a member having hardness lower than that of the positioning surface 37. In the present embodiment, the cleaning member 39 is configured with a sponge member. The cleaning member 39 has a function of collecting foreign substances (for example, cut chips of the intermediate transfer belt 5) attached to the inner peripheral surface of the intermediate transfer belt 5. It is noted that instead of the sponge member, a brush member may also be employed.

Figure 4:
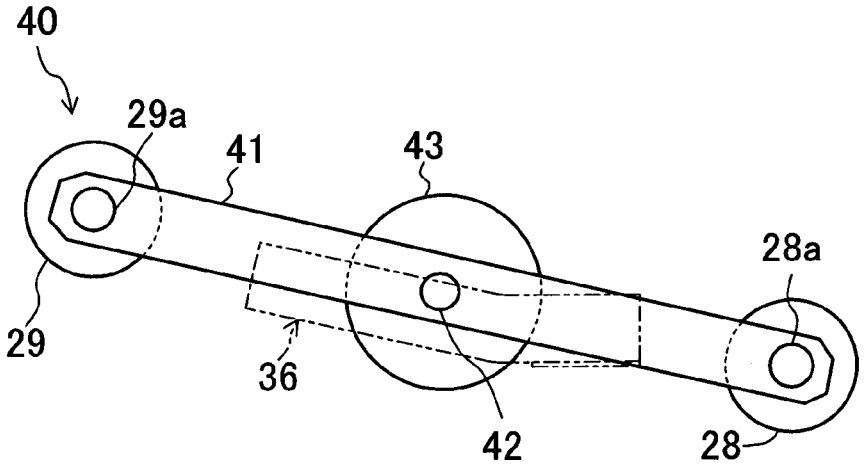
FIG. 4 is a schematic side view illustrating a state switching mechanism.

The aforementioned image forming apparatus 1 further has a state switching mechanism 40 (illustrated Only in FIG. 4). The state switching mechanism 40 is configured to be able to switch a positioning state in which the inner peripheral surface of the intermediate transfer belt 5 abuts the positioning surface 37 of the positioning member 36 and a cleaning state in which the inner peripheral surface of the intermediate transfer belt 5 abuts the cleaning surface 38 of the positioning member 36.

The state switching mechanism 40 has the aforementioned third and fourth tension rollers 28 and 29, a connection bar (a connection member) 41, a support shaft 42, and a driving motor 43. The third tension roller 28 is arranged at the upstream side of the positioning member 36 in the belt rotation direction, and the fourth tension roller 29 is arranged at the downstream side of the positioning member 36 in the belt rotation direction. Both tension rollers 28 and 29 are connected to each other by the connection bar 41 having a rectangular plate shape. That is, a roller shaft 28*a* of the third tension roller 28 is rotatably supported to one end portion of the connection bar 41, and a roller shaft portion 29*a* of the fourth tension roller 29 is rotatably supported to the other end portion of the connection bar 41. An intermediate portion of the connection bar 41 is rotatably supported by the support shaft 42. The support shaft 42 is connected to the driving motor 43 (a driving unit) so as to be able to transmit power. The driving motor 43 is fixed to the side wall portion (not illustrated) of the intermediate transfer unit 30. The operation of the driving motor 43 is controlled by the controller (a control unit) 100 which will be described later.

Figure 5:
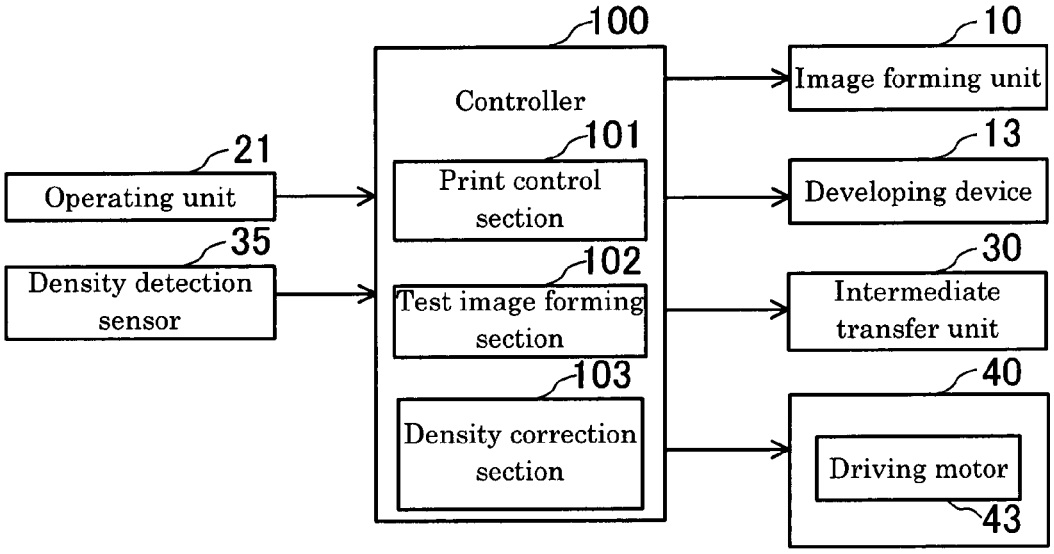
FIG. 5 is a block diagram illustrating a part of a control system of an image forming apparatus.

The controller 100 (see FIG. 5) includes a microcomputer having a CPU, a ROM, a RAM and the like. The controller 100, for example, controls the operations of the image forming units 10, the developing device 13, the intermediate transfer unit 30, and the state switching mechanism 40 based on signals from an operating unit 21 and the density detection sensors 35. In detail, the controller 100 has a print control section 101, a test image forming section 102, and a density correction section 103. The print control section 101, for example, performs a print process on the recording paper P based on image data transmitted from an external terminal. The test image forming section 102 forms a test image (also called a patch image) at both end portions of the outer peripheral surface of the intermediate transfer belt 5 in the width direction and issues a density detection instruction to the density detection sensors 35 when the print process is not performed in the print control section 101 (during a time between print jobs). Based on the density of the aforementioned test image detected by the density detection sensors 35, the density correction section 103 adjusts a developing bias of the developing device 13, thereby correcting the density of an image printed on the recording paper P to preset reference density.

Figure 6:
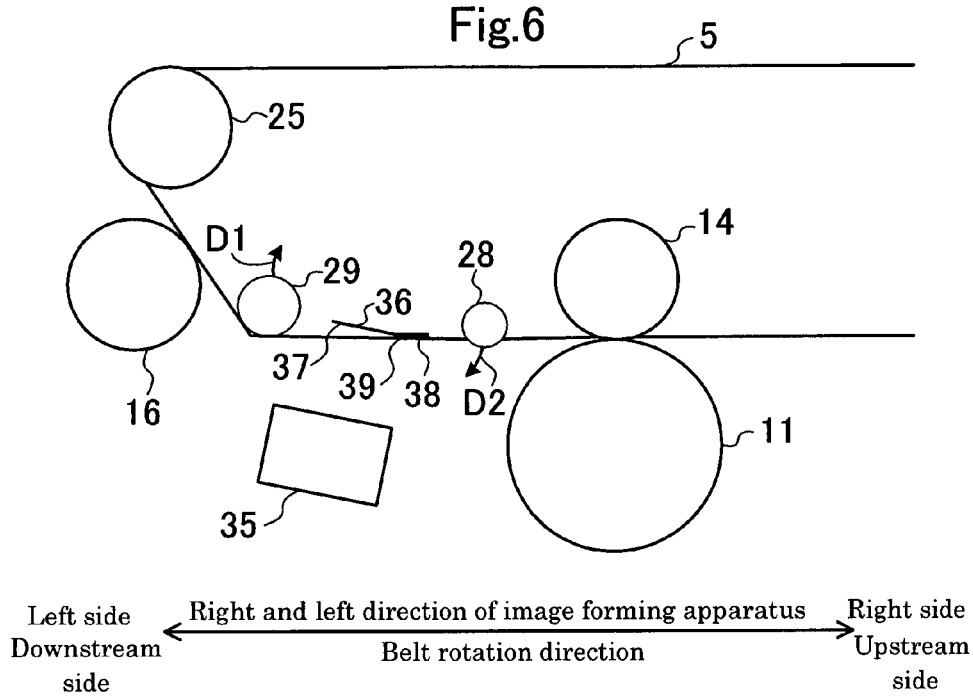
FIG. 6 is an explanation diagram for explaining an operation of a switching mechanism and a diagram illustrating a state (a cleaning state) when a density correction process is not performed.

When the image density correction process is not performed by the density correction section 103, the controller 100 controls an rotation angle of the driving motor 43 of the state switching mechanism 40, thereby allowing the cleaning surface 38 (the cleaning member 39) of the positioning member 36 to abut the inner peripheral surface of the intermediate transfer belt 5 (allowing the positioning member 36 to be in the cleaning state) as illustrated in FIG. 6. At this time, the secondary transfer roller 16 has been brought into press-contact with the outer peripheral surface of the intermediate transfer belt 5 with predetermined press-contact load.

Figure 7:
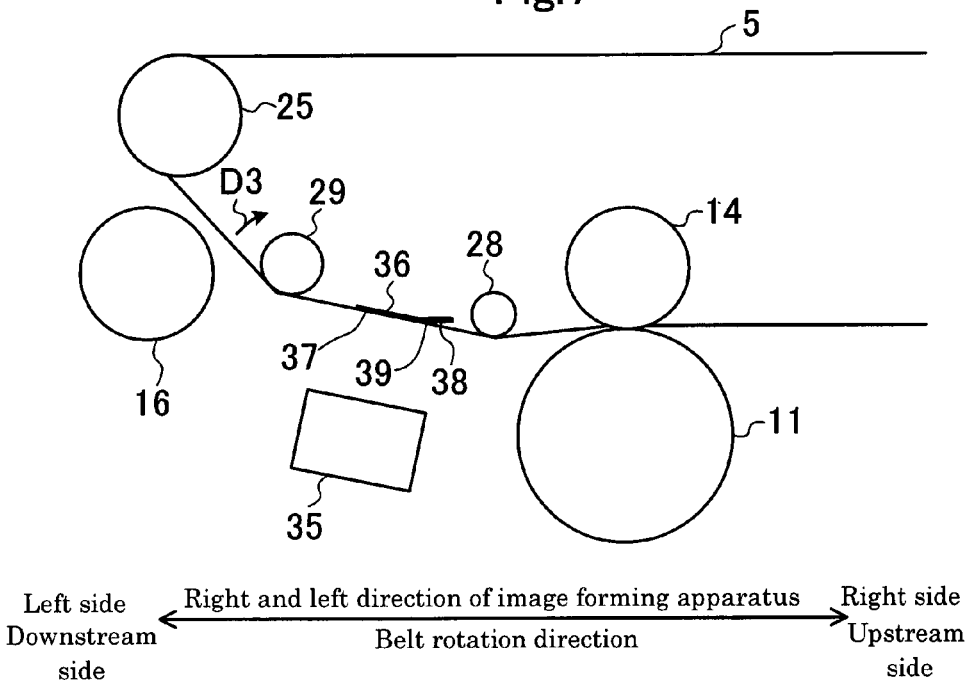
FIG. 7 is an explanation diagram for explaining an operation of a switching mechanism and a diagram illustrating a state (a positioning state) when a density correction process is performed.

When the image density process is performed, the controller 100 rotates the driving motor 43 of the state switching mechanism 40 from the state of FIG. 6, thereby rotating the connection bar 41 (illustrated only in FIG. 4) around the support shaft 42 in a clockwise direction of FIG. 6. Then, since the fourth tension roller 29 moves to the right side and the upper side (see an arrow D1 of FIG. 6) and the third tension roller 28 moves to the left side and the lower side (see an arrow D2 of FIG. 6), the tension state of the intermediate transfer belt 5 changes, so that the positioning surface 37 of the positioning member 36 abuts the inner peripheral surface of the intermediate transfer belt 5 (the positioning member 36 enters the positioning state). Furthermore, with the movement of the aforementioned fourth tension roller 29, since a part of the intermediate transfer belt 5, which faces the secondary transfer roller 16, is displaced inward in the radial direction of the belt (see an arrow D3 of FIG. 7), the press contact between the secondary transfer roller 16 and the intermediate transfer belt 5 is released, so that the secondary transfer roller 16 is separated from the outer peripheral surface of the intermediate transfer belt 5.

Figure 8:
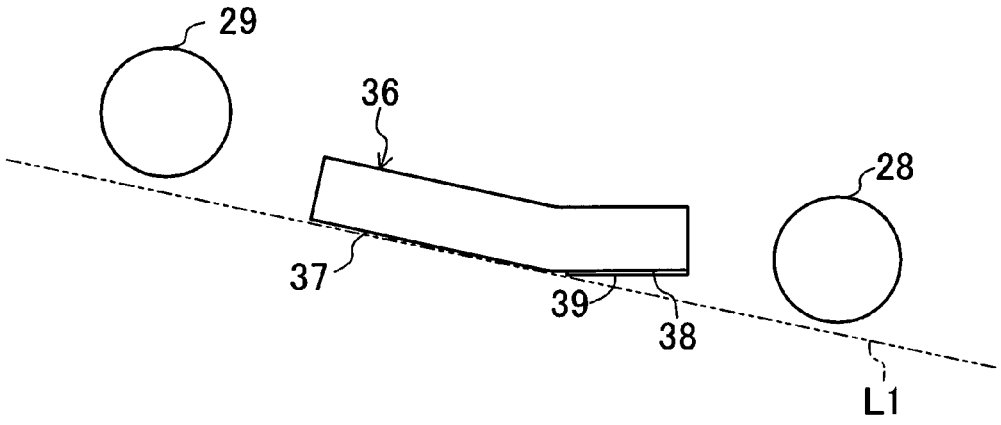
FIG. 8 is an explanation diagram for explaining an arrangement position of tension rollers in a positioning state.

As described above, in the aforementioned embodiment, when the image density correction process is performed by the controller 100, since the positioning member 36 enters the positioning state by the state switching mechanism 40, the positioning surface 37 of the positioning member 36 abuts the inner peripheral surface of the intermediate transfer belt 5. In this way, since the position (the distance) of the intermediate transfer belt 5 is maintained to be constant with respect to the density detection sensors 35, the density detection accuracy of the test image by the density detection sensors 35 is improved, so that it is possible to improve density detection accuracy by the controller 100. In order to allow the positioning surface 37 to reliably abut the intermediate transfer belt 5, it is preferable that the third and fourth tension rollers 28 and 29 in the aforementioned positioning state are arranged above an extension line L1 (see FIG. 8) of the positioning surface 37 when viewed from the longitudinal direction of the positioning member 36.

Figure 9:
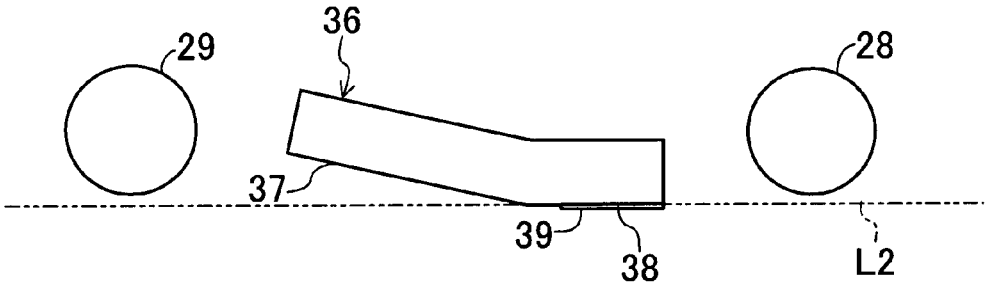
FIG. 9 is an explanation diagram for explaining an arrangement position of tension rollers in a cleaning state.

When the image density correction process is not performed by the controller 100, since the positioning member 36 enters the cleansing state by the state switching mechanism 40, the cleaning member 39 provided to the cleaning surface 38 of the positioning member 36 abuts the inner peripheral surface of the intermediate transfer belt 5. In this way, it is possible to suppress loss (abrasion) of the intermediate transfer belt 5 as compared with the case in which the positioning surface 37 having high hardness abuts the inner peripheral surface of the intermediate transfer belt 5. Thus, it is possible to improve the lifespan of the intermediate transfer belt 5. Furthermore, by using the cleaning member 39, it is possible to collect cut chips of the intermediate transfer belt 5, which have been generated when the positioning surface 37 abuts the intermediate transfer belt 5 at the time of execution of the aforementioned density correction process. Thus, it is possible to prevent sliding from occurring between the driving roller 25 and the intermediate transfer belt 5 due to attachment of the cut chips of the intermediate transfer belt 5 to the driving roller 25. Accordingly, it is possible to prevent a variation of a driving speed of the intermediate transfer belt 5. In order to allow the cleaning member 39 to reliably abut the intermediate transfer belt 5, it is preferable that the third and fourth tension rollers 28 and 29 in the aforementioned cleaning state are arranged above an extension line L2 (see FIG. 9)

of the cleaning surface 38 when viewed from the longitudinal direction of the positioning member 36.

Moreover, in the aforementioned embodiment, since the state switching mechanism 40 has a separate/contact mechanism for allowing the secondary transfer roller 16 to be separated from or to make contact with the intermediate transfer belt 5, the state switching mechanism 40 is configured to allow the secondary transfer roller 16 to be separated from the intermediate transfer belt 5 in the aforementioned positioning state (see FIG. 7), and to allow the secondary transfer roller 16 to make contact with the intermediate transfer belt 5 in the aforementioned cleaning state (see FIG. 6).

According to this, at the time of the density correction process requiring no secondary transfer, the secondary transfer roller 16 is separated from the intermediate transfer belt 5, so that it is possible to prevent the secondary transfer roller 16 from unnecessarily abutting the intermediate transfer belt 5. Furthermore, it is possible to reduce the manufacturing cost as compared with the case in which the separate/contact mechanism of the secondary transfer roller 16 is provided separately from the state switching mechanism 40.

Furthermore, in the aforementioned embodiment, the positioning member 39 is configured with a sponge member. According to this, it is possible to sufficiently reduce the hardness of the positioning member 39 abutting the inner peripheral surface of the intermediate transfer belt 5. Thus, it is possible to reliably suppress the loss of the intermediate transfer belt 5.

Furthermore, in the aforementioned embodiment, insulating coating is performed on the positioning surface 37 of the positioning member 36. According to this, toner flying in the image forming apparatus 1 is prevented from being attached to the positioning surface 37, so that it is possible to prevent rubbing scratches from occurring in the inner peripheral surface of the intermediate transfer belt 5 due to the toner.

Furthermore, in the aforementioned embodiment, the positioning member 36 is configured with a metal member. According to this, as compared with the case in which the positioning member 36, for example, is configured with a plastic member, the stiffness of the positioning member 36 is improved, so that it is possible to suppress vibration of the positioning member 36. Accordingly, it is possible to prevent vibration scratches from occurring in the inner peripheral surface of the intermediate transfer belt 5 due to the vibration of the positioning member 36.

OTHER EMBODIMENTS

In the aforementioned embodiment, the state switching mechanism 40 is configured to displace the intermediate transfer belt 5 by displacing the third tension roller 28 and the fourth tension roller 29, thereby switching the positioning state and the cleaning state; however, the present invention is not limited thereto. That is, the state switching mechanism 40 may also be configured to displace the positioning member 36, thereby switching the positioning state and the cleaning state.

In the aforementioned embodiment, the insulating coating is performed on the positioning surface 37 of the positioning member 36; however, the present invention is not limited thereto and plastic coating may also be simply performed. In this way, a friction coefficient of the positioning surface 37 is reduced, so that it is possible to improve the sliding of the intermediate transfer belt 5 with respect to the positioning surface 37. Thus, it is possible to reliably suppress the loss of the belt 5, which occurs when the positioning surface 37 abuts the inner peripheral surface of the intermediate transfer belt 5.

What is claimed is:

1. An image forming apparatus comprising:

a photosensitive drum having a peripheral surface on which a toner image is formed;

an endless intermediate transfer belt to which the toner image of the peripheral surface of the photosensitive drum is primarily transferred;

a driving roller that abuts an inner peripheral surface of the intermediate transfer belt and rotationally drives the intermediate transfer belt;

a secondary transfer roller for secondarily transferring the toner image transferred to the intermediate transfer belt to a recording paper;

a test image forming section that forms a test image on an outer peripheral surface of the intermediate transfer belt;

a density detection sensor arranged at a radial outside of the intermediate transfer belt and detecting density of the test image formed by the test image forming section;

a positioning member that is arranged facing the density detection sensor while the intermediate transfer belt is held between the density detection sensor and the positioning member, and abuts the inner peripheral surface of the intermediate transfer belt; and a density correction section that performs an image density correction process based on the density of the test image detected by the density detection sensor, wherein the positioning member has a positioning surface that abuts the inner peripheral surface of the intermediate transfer belt to perform positioning of the intermediate transfer belt with respect to the density detection sensor and a cleaning surface coated with a cleaning member having hardness lower than hardness of the positioning surface and abutting the inner peripheral surface of the intermediate transfer belt via the cleaning member, and the image forming apparatus further comprises:

a state switching mechanism that is able to switch a positioning state in which the positioning surface of the positioning member abuts the inner peripheral surface of the intermediate transfer belt and a cleaning state in which the cleaning surface of the positioning member abuts the inner peripheral surface of the intermediate transfer belt via the cleaning member and cleans the inner peripheral surface; and a control unit that allows the state switching mechanism to be in the positioning state when the correction process is performed by the density correction section while allowing the state switching mechanism to be in the cleaning state when the correction process is not performed by the density correction section.

2. The image forming apparatus of claim 1, wherein the state switching mechanism has a separate/contact mechanism for allowing the secondary transfer roller to be separated from or to make contact with the intermediate transfer belt, and is configured to allow the secondary transfer roller to be separated from the intermediate transfer belt in the positioning state and to allow the secondary transfer roller to make contact with the intermediate transfer belt in the cleaning state.

3. The image forming apparatus of claim 1, wherein the positioning surface is connected to a downstream side end of the cleaning surface in a belt rotation direction and is inclined with respect to the cleaning surface in the belt rotation direction, and the state switching mechanism comprises:

an upstream side tension roller arranged at an upstream side of the positioning member in the belt rotation direction;

a downstream side tension roller arranged at a downstream side of the positioning member in the belt rotation direction;

a connection member that connects the upstream side and downstream side tension rollers to each other;

a support shaft that rotatably supports the connection member between the upstream side tension roller and the downstream side tension roller; and a driving unit that rotationally drives the connection member around the support shaft, wherein the connection member is rotated around the support shaft by the driving unit to displace positions of the upstream side and downstream side tension rollers, so that the positioning state and the cleaning state are switched.

4. The image forming apparatus of claim 1, wherein the cleaning member includes a sponge member or a brush member.

5. The image forming apparatus of claim 1, wherein insulating coating has been performed on the positioning surface of the positioning member.

6. The image forming apparatus of claim 1, wherein plastic coating has been performed on the positioning surface of the positioning member.

7. The image forming apparatus of claim 1, wherein the positioning member includes a metal member.

* * * * *